US006665502B2

(12) United States Patent
Hirobe et al.

(10) Patent No.: US 6,665,502 B2
(45) Date of Patent: Dec. 16, 2003

(54) IMAGE FORMING APPARATUS WITH ELECTROSTATIC POTENTIAL-BASED DEVELOPER CORRECTION

(75) Inventors: Fumitake Hirobe, Kanagawa (JP); Shigeo Kimura, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/873,292

(22) Filed: Jun. 5, 2001

(65) Prior Publication Data

US 2002/0028083 A1 Mar. 7, 2002

(30) Foreign Application Priority Data

Jun. 6, 2000 (JP) ..... 2000-168985
Jun. 6, 2000 (JP) ..... 2000-168997

(51) Int. Cl.[7] ..... G03G 15/00
(52) U.S. Cl. ..... 399/49
(58) Field of Search ..... 399/48, 49

(56) References Cited

U.S. PATENT DOCUMENTS 4,724,461 A * 2/1988 Rushing ..... 399/48
5,694,223 A * 12/1997 Katori et al. ..... 399/49 X
5,805,956 A * 9/1998 Kawai et al. ..... 399/48 X
5,819,132 A * 10/1998 Hirobe ..... 399/49
5,913,092 A * 6/1999 Bisaiji et al. ..... 399/49
5,995,777 A * 11/1999 Nagamochi et al. ..... 399/49

* cited by examiner

*Primary Examiner*—Fred L. Braun
(74) *Attorney, Agent, or Firm*—Fitzpatrick, Cella, Harper & Scinto

(57) ABSTRACT

The present invention concerns controlling a potential used to form an electrostatic image for image formation. According to the invention, an electrostatic latent image is formed on an image bearing member using, for example, a potential stored in a memory. The potential of the latent image is detected, and if the potential is not within a specified range, the potential is controlled (i.e., changed) to form another latent image with the changed potential. The latent image is then developed and the density of the developed image detected. In one embodiment, the amount of developer to be replenished is then controlled based upon the detected density and a target potential value, where the target potential value is determined and set based on the detected density and the potential used in the potential controlling step. In a related embodiment, when a result of the potential obtained after termination of a normal image formation process is out of a designated range, potential control is performed after termination of a next normal image formation process.

11 Claims, 9 Drawing Sheets

IMAGE FORMING APPARATUS WITH ELECTROSTATIC POTENTIAL-BASED DEVELOPER CORRECTION

BACKGROUND OF THE INVENTION

1. Field of the Invention

The present invention relates to an image forming apparatus that uses an electrophotographic method or an electrostatic recording method. More particularly, the invention relates to an image forming apparatus, such as a copying machine, a printer, a FAX, among some others.

2. Related Background Art

Generally, a monocomponet developer using magnetic toner as the main component or two-component developer using non-magnetic toner and magnetic carrier as the main component thereof are used for the developing device that serves as developing means provided for an image forming apparatus using an electrophotographic method or an electrostatic recording means. For the image forming apparatus that forms full color or multicolor images by means of the electrophotographic method, in particular, most of the developing devices thereof adopt the two-component developer in consideration of color tones of images or the like.

As well known, the toner density (the ratio of toner weight to the-total weight of carrier and toner) of the two-component developer is an extremely important factor for stabilizing the image quality. During development, the toner of a developer is consumed to reduce the toner density of the developer. Therefore, the toner density in a developer or image density should be detected timely in order to replenish toner depending on such changes. Then, the toner density or image density is controlled to be constant at all times for the maintenance of image quality.

Here, conventionally, density control devices of various types have been proposed for the constant control of the toner density or image density by performing the toner replenishment control for a developing device the toner density of which has been reduced.

For example, as a method for keeping the toner density constant in a developer in a developing container of a developing device, there is the one that controls the toner density of the developer in the developing container by detecting the amount of reflected light therefrom (developer reflection control) or the one that makes control by detecting the magnetic permeability of the magnetic carrier in an developer in a developing container (inductance control), among some others.

However, the method for keeping the toner density of a developer constant is arranged to detect the toner density of the developer directly. Therefore, although it is possible to keep the toner density in the developer constant, the developing capability is caused to change if the amount of friction charging (triboelectrification) of toner changes due to a long term use that allows the quality of toner or magnetic carrier in the developer to change, leading to a drawback that the image density is also caused to change concurrently.

For the recent image forming apparatus, therefore, it is generally practiced to adopt a method (patch detection control) for controlling the developer density in which a reference image (hereinafter referred to as a "patch image") is formed on a photosensitive drum serving as image bearer, and then, the amount of toner adhesion thereto is detected by an optical detection sensor serving as density detection means arranged to face the photosensitive drum. With this patch detection control method, it becomes possible to keep the image density substantially constant, because the amount of toner adhesion of the patch image on the photosensitive drum is detected to effectuate the replenish control. However, there has been known a great influence that may be exerted by the sensitivity characteristics of the photosensitive drum and the like.

Here, the specific description will be made in conjunction with FIG. 3. FIG. 3 shows the E-V characteristics divided by 8 bits, in which the axis of ordinate indicates the potential (V) on a drum, and the axis of abscissa indicates the laser level. In FIG. 3, the sensitivities of the photosensitive drum before and after duration are indicated. It is understandable from the representation of FIG. 3 that the halftone sensitivity of the photosensitive drum used for this examination is deteriorated after duration. Also, the density of the patch image which is used for the patch detection control is a halftone density with the characteristics of the optical detection sensor and the image stability taken into consideration.

As a result, if the patch detection control is made on a photosensitive drum after duration where the sensitivity has been deteriorated, the contrast potential of a patch image is reduced, because the halftone latent image potential, that is, the potential of the patch latent image, is higher than the one initially set. Consequently, the developing characteristics of the patch image is made lower than the one before duration. Then, in order to compensate for this reduction of developing characteristics, control means should repeat toner replenishment. Thus, changes take place as indicated by developing characteristic curves indicated in FIG. 4 when the developing characteristics are restored to the initial ones. In this respect, the image density shown in FIG. 4, that is, the patch image density, is measured at 0.8 of the X-rite reflecting densitometer.

Now, as described earlier, the quality of toner or magnetic carrier in a developer should change due to a long term use, and if the recovery thereof becomes difficult only by means of toner replenishment control, the developer should be replaced then or before such difficulty may take place. Thus, the initial status of the developer should be detected to set the reference value of patch image density (hereinafter referred to as the "initial setting") when the developer is replaced (which includes the replacement of toner replenishment container that contains toner to be replenished to a developing device detachably mountable on an image forming apparatus). This initial setting is an extremely important sequence, because it provides the target value of riding amount of toner on the photosensitive drum thereafter. However, if the initial setting is executed in a status that the sensitivity of photosensitive drum is allowed to vary due to the individual difference or durability deterioration between each of the photosensitive drums, it inevitably exerts great influence on the image density transition after the initial setting.

Also, at the time of usual initial setting, the patch laser levels, which are determined by the installation environment or the environmental history of an apparatus, are indicated on a table or the like, and used after having been stored on the main body of the apparatus. However, the aforesaid patch levels are fixed and used for the initial setting even after developer has been replaced. As a result, the initial setting is made inevitably in a status where no compensation is provided for the latent potential of the patch image.

As described above, with the conventional patch detection control at the time of initial setting which is needed after developer replacement or the like, the developing characteristic curve after duration is caused to change under any circumstances due to the inadequate setting for the initialization which is accompanied by the changes of photosensitivity characteristics of the photosensitive drum. Then, it is often encountered that the resultant image density changes greatly.

SUMMARY OF THE INVENTION

The present invention is designed in consideration of the problems discussed above. It is an object of the invention to provide an image forming apparatus capable of optimizing the potential of electrostatic latent image for detection use even when the photosensitivity characteristics of the image bearer are caused to vary due to endurance.

It is another object of the invention to provide an image forming apparatus capable of optimizing the amount of developer to be replenished to developing means.

It is still another object of the invention to provide an image forming apparatus capable of optimizing the target value to be compared with the output of density detection means.

The above-mentioned and other objects, features and advantages of the present invention will become more apparent by reference to the following detailed description of the invention taken in conjunction with the accompanying drawings.

DETAILED DESCRIPTION OF THE PREFERRED EMBODIMENTS

Figure 1:
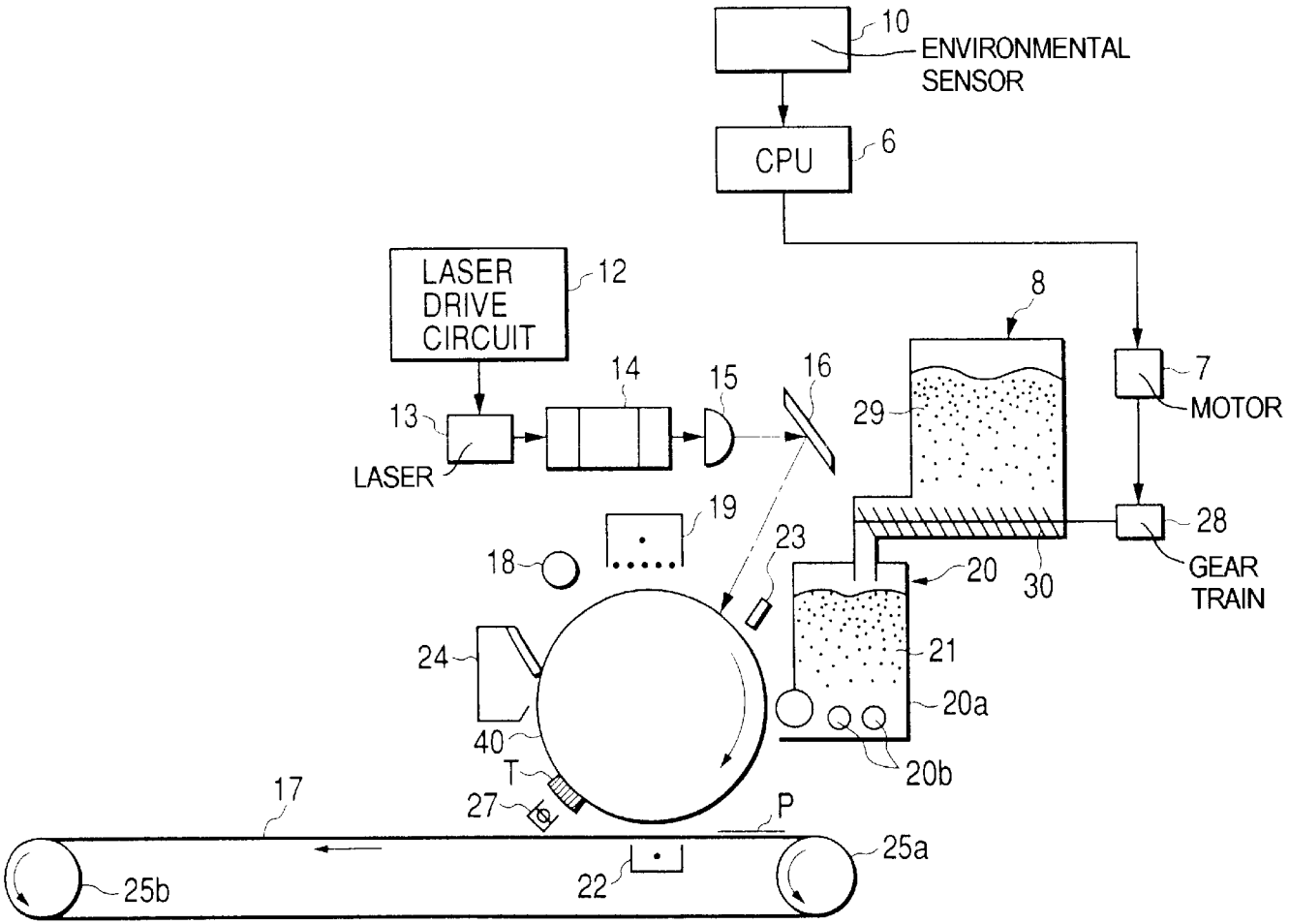
FIG. 1 is a view which schematically shows the structure of an image forming apparatus in accordance with one embodiment of the present invention.

Hereinafter, in conjunction with the accompanying drawings, the description will be made of an image forming apparatus further in detail in accordance with the present invention.

(First Embodiment)

In conjunction with FIG. 1 and FIG. 2, a first embodiment will be described in accordance with the present invention.

At first, the image forming apparatus of the present invention will be described in conjunction with FIG. 1. In this respect, however, in order to simplify the description, the view which contains only a single image forming station (including a photosensitive drum 40 serving as image bearer; a pre-exposing device 18; a primary electrostatic charger 19 serving as charging means; a developing device 20 serving as developing means; a cleaner 24; and some others) is used for description. In case of a color image forming apparatus, however, the structure is arranged so that cyan, magenta, yellow, and black developing devices are provided in that order, for example, to face the photosensitive drum 40, respectively.

Here, for the present embodiment, the description will be made of a digital color copying machine of electrophotographic type, but it is of course possible to apply the present invention equally to various other image forming apparatuses of electrophotographic type or electrostatic recording type, as well as to an image forming apparatus that forms black and white images.

Now, at first, the image on a source document is read out by CCD (not shown), and the binalized image signals, the pulse width of which is modulated in accordance with the image signals thus obtained, are inputted into a laser driving circuit 12 without any modification, and used as the on and off control signals for light emission of the laser diode 13 which serves as exposing means. Laser beams emitted from the laser diode 13 are scanned in the main scanning direction by use of a known polygonal mirror 14, and irradiated to the photosensitive drum 40 rotating in the direction indicated by an arrow through an f/θ lens 15 and a reflection mirror 16. Thus, an electrostatic latent image is formed.

On the other hand, the photosensitive drum 40 is uniformly deelectrified by means of the pre-exposing device 18, and uniformly charged negatively, for example, by use of the primary electrostatic charger 19. After that, with the aforesaid laser beams irradiation, the electrostatic latent image is formed corresponding to the image signals. This latent image is developed as the visual image (toner image) by means of the developing device 20 using reversal developing method. The toner image formed on the photosensitive drum 40 is transferred by the action of a transfer charger 22 to the recording material P which is conveyed to the photosensitive drum 40 by the recording material carrying belt 17 serving as the recording material bearer. The recording material carrying belt 17 is tensioned around two roller 25*a* and 25*b* to be driven endlessly in the direction indicated by an arrow in FIG. 1 so that the recording material P borne thereon is conveyed to the photosensitive drum 40. After transfer, the transfer residual toner which remains on the photosensitive drum 40 is scraped off by use of the cleaner 24.

Also, in order to execute the patch detection control, which is the image density stabilization control, subsequent to the completion of image formation, the patch image T for reference use is formed on the photosensitive drum 40 at the single tone density level (for the present embodiment, 0.8 is adopted using the X-rite reflecting densitometer), and then, developed for detecting the density of the patch image T by use of a density sensor 27 serving as density detection means having the light emitting and photosensitive portions installed to face the photosensitive drum 40. The value thus detected is transmitted to a CPU 6.

The CPU compares the detected value Sgnl with the initial density reference value (SgnlInit), which is stored in advance on a ROM serving as storing means, in order to work out the over or short amount of toner needed to effectuate the restoration of toner density to the initial density reference value (SgnlInit). More specifically, the calculation is made by the following formula:

Toner over or short amount=(*SgnlInit*−*Sgnl*)/(the signal level difference Δ of 1% toner density)×(the toner amount of toner density 1% portion)

The toner over or short amount thus worked out indicates positive or negative status. Then, it is determined that the toner is in short condition if the positive status is indicated, and that the toner is in over condition if the negative status is indicated, for example.

If the toner is determined to be in short status, the toner conveyance screw 30, which is connected with a motor 7 through a gear train 28, is driven to rotate for supplying the replenishing toner 29 from the interior of a replenishment tank 8 to the interior of the developing device 20.

Next, in conjunction with a flowchart shown in FIG. 2, the description will be made of the control of the patch latent image potential at the time of initial setting after the developer 21 in the developing device 20 has been replaced, as well as a method for determining the reference value (target value) of the patch detection density. These constitute the characteristic parts of the present invention.

In accordance with the present embodiment, after the replacement of developer 21 or the replacement of the replenishment container detachably mountable of an image forming apparatus, which contains developer to be replenished to the developing device (S100), the developer is agitated, at first, by use of the agitating conveyer screw 20*b* in the developing container 20*a* in order to stabilize the tribo (the amount of electrostatically charged load per unit weight) of the developer. After that, the potential Vref of the environmental patch latent image is determined (S102) depending on the environment under which the apparatus is installed or on the environmental history of the apparatus. Then, the patch latent image is formed (S103) at a certain laser level (exposing time), and the patch latent image potential Vp is measured by use of the surface potential sensor 23 which serves as potential detection means (S104). Subsequently, the patch latent image potential difference Vdif (=Vref−Vp) is worked out (S105). If the result is within a designated potential difference (plus minus 5V for the present embodiment), a developing bias is applied to the developing device 20 to develop the patch latent image (S108), and then, the resultant patch latent image density detected by use of the sensor 27 is stored on the ROM as the initial density reference value SgnlInit (S109). When the CPU works out the patch latent image potential difference Vdif (=Vref−Vp) (S105), it is determined that the patch latent image potential Vp is higher than a designated potential if the Vdif is greater than 5V. Then, the laser level previously set at the formation of the patch latent image is made higher by one step (S106), and a patch image is formed again, thus detecting the patch latent image potential Vp (S104). On the contrary, if the Vdif is smaller than −5V, it is determined that the patch latent image potential is lower than the designated potential, and the laser level is made lower by one step (S107). Thus, a patch latent image is again formed for the detection of the patch latent image potential Vp (S104).

If the patch latent image potential difference Vdif should be out of a designated range, the CPU repeats the aforesaid sequence. Then, when the Vdif is found to be within the designated potential difference (the patch latent image potential Vp being within a designated range), a developing bias is applied to the developing device 20 in the same manner as described earlier to develop the patch latent image the potential of which is adequately controlled. Then, the value of patch density signal is detected by the patch detection sensor 27. The result of measurement is stored as the initial density reference value SgnlInit on the ROM that serves as storing means.

Lastly, the patch laser level thus obtained in the aforesaid initial setting sequence needed to form the patch latent image, the potential of which is optimized by the execution of potential control, is stored on the ROM (S110). Then, this is used as the patch laser level for the patch sequence to follow.

As described above, the initial setting is effectuated in the condition of patch image formation which becomes a designated patch latent image potential so as to make it possible to eliminate any unfavorable effect that may be brought about by the fluctuation of the photosensitivity characteristics of the photosensitive drum. Also, thereafter, the patch is formed in the condition obtained at the time of initial setting. Therefore, it becomes possible to execute the toner replenishing control to the developing device in good condition, hence suppressing the fluctuation of image density.

(Second Embodiment)

Next, the description will be made of a second embodiment in accordance with the present invention.

In accordance with the first embodiment, if the patch latent image potential difference Vdif should be more than a designated potential difference, the laser level is controlled to change it by one step portion under any circumstances when the next patch laser level is determined. However, with this control method, the Vdif is not easy to be brought into the range of a designated potential difference if it is extremely large, and it takes a considerable time to execute the initial setting sequence, leading to a problem that the downtime is increased inevitably.

Here, therefore, the present embodiment is designed to control the patch laser level by making the amount of changes variable depending on the potential difference of obtained patch latent image. More specifically, the amount of obtained laser level change is acquired by the following formula, and the patch laser level is modified in accordance with the value thus acquired:

The laser level changing amount=the patch potential difference/10*V*

As a result, an image forming condition can be found quickly to enable a designated patch latent image potential to be obtained, hence making it possible to execute the initial setting sequence smoothly.

(Third Embodiment)

Figure 3:
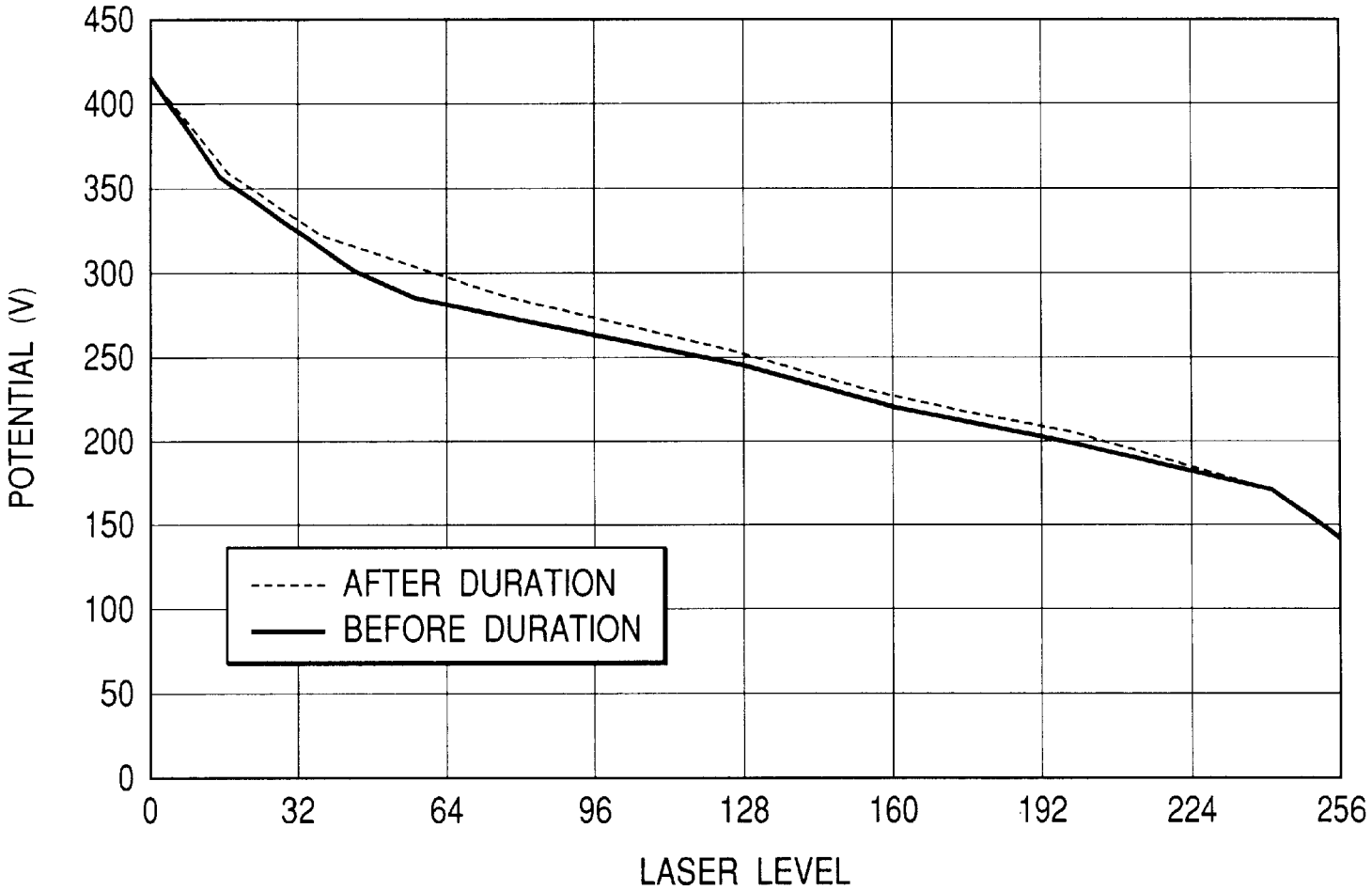
FIG. 3 is a characteristic view which shows one example of the changing condition of a photosensitive drum potential.

In accordance with the present embodiment, the light portion and dark portion potentials on the photosensitive drum are guaranteed before the execution of the initial setting sequence. Then, after that, the patch latent image potential is measured to make the initial setting. In other words, as shown in FIG. 3, the aforesaid initial setting is executed after the potential is controlled so that when the laser level is at 0 (minimum) and at 256 (maximum), the potentials on the photosensitive drum may become designated ones, respectively. After that, the aforesaid initial setting sequence is executed.

In this way, it is made possible to determine the patch latent image potential in an extremely good precision, because the initial setting sequence is executed after the light portion and dark portion potentials are guaranteed in accordance with the surface sensitivity of the photosensitive drum.

(Fourth Embodiment)

In accordance with a fourth embodiment, the laser exposure intensity is varied in order to make the patch latent image potential a designated potential.

Figure 2:
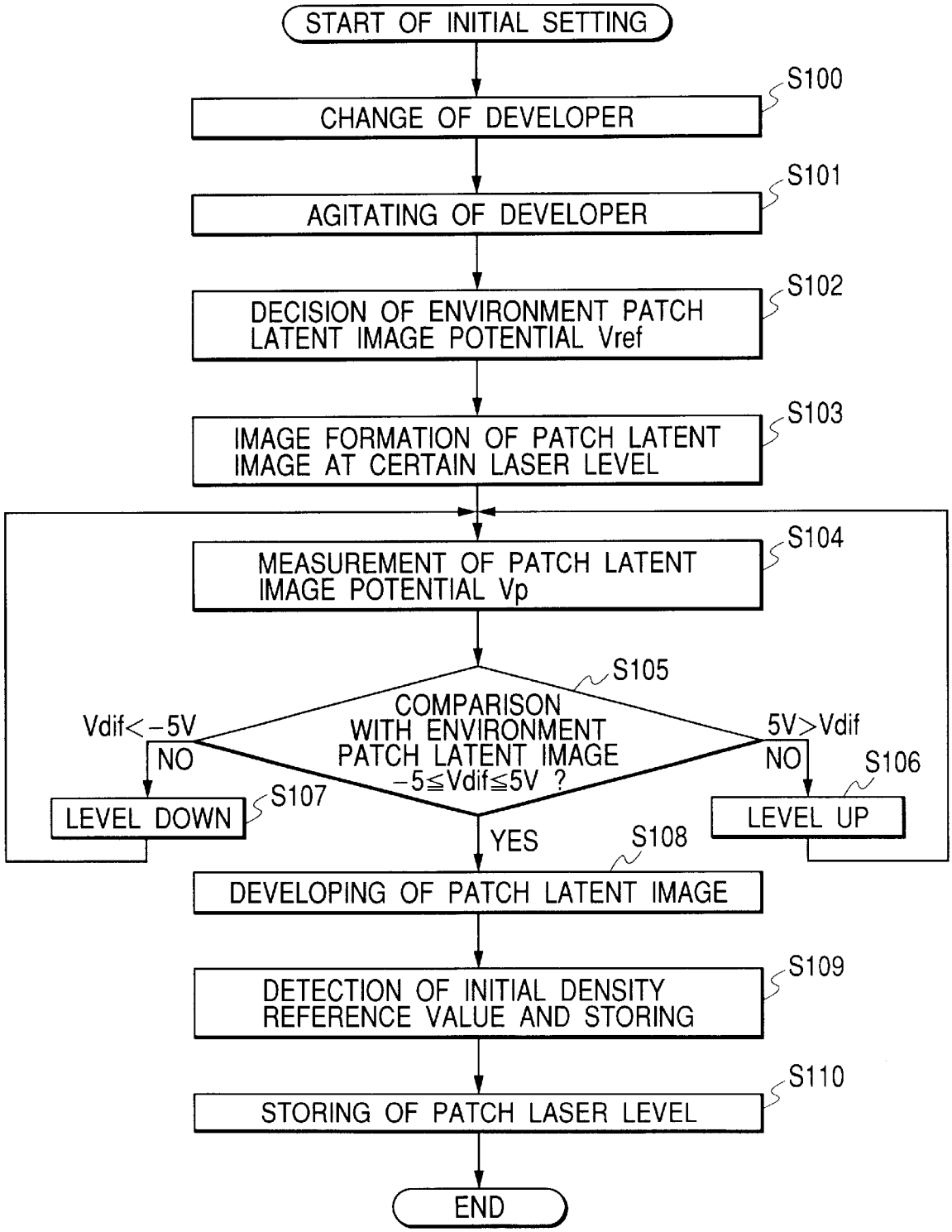
FIG. 2 is a flowchart which shows one embodiment of a patch latent image potential control at the time of initial setting.

More specifically, if the patch latent image potential difference Vdif is larger than 5V as shown in FIG. 2, the laser power is increased by one step, and if it is smaller than −5V, the laser power is reduced by one step. In this way, the same effect as that of the first embodiment becomes obtainable.

(Fifth Embodiment)

At first, the description will be made of a method for controlling potential, which is also adopted for the first to fourth embodiments.

The potential control is such a control as to prevent the maximum image density from being changed, and the white background fogging from being aggravated by detecting and correcting the changed duration characteristics of the photosensitive drum. More specifically, it is a control whereby to obtain the grid potential of charging means, and the developing bias potential of developing means from the contrast potential that can guarantee the maximum image density.

Figure 8:
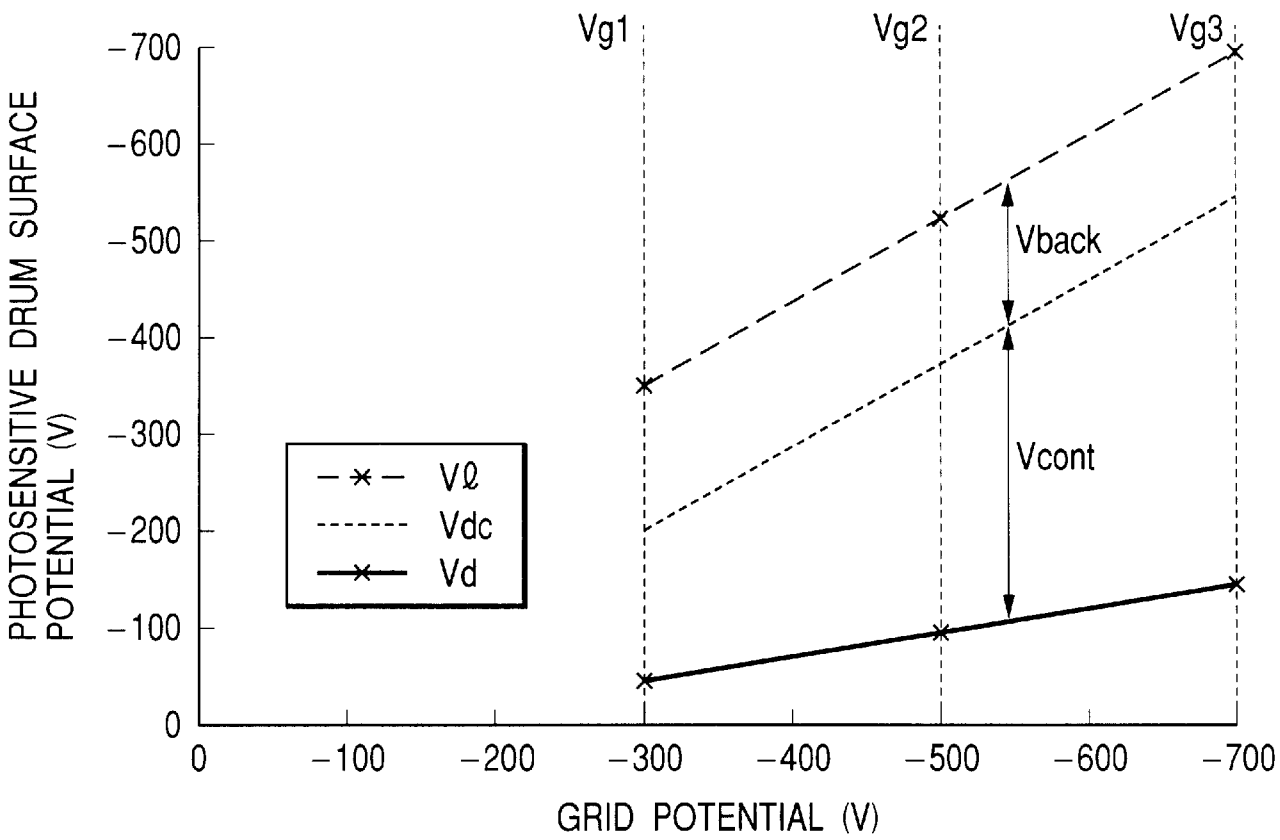
FIG. 8 is a graph which shows the relationship between the grid potential and the surface potential of a photosensitive drum.
Figure 9:
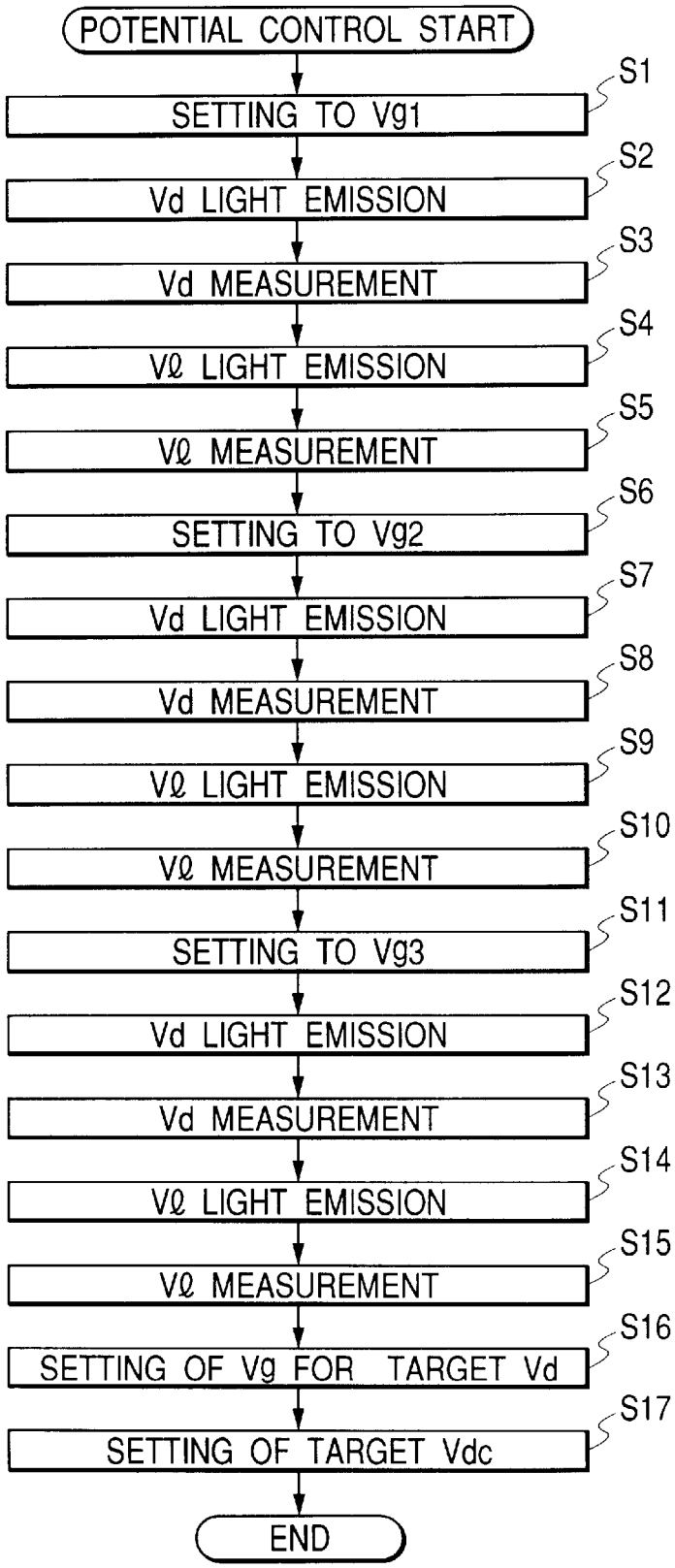
FIG. 9 is a flowchart which shows one example of the conventional potential control sequence.

Now, the description will be made of the method for controlling potential. Here, FIG. 8 is a graph which shows the relationship between the grid potential and the surface potential of the photosensitive drum. FIG. 9 is a flowchart which shows the sequence of potential measurement.

At first, the grid potential is set at Vg1=−300V (S1), and then, the surface potential of the photosensitive drum (dark portion potential) Vd at the time of being scanned at the minimum level of the light emission pulse of the semiconductor laser serving as exposing means, and the surface potential of the photosensitive drum (light portion potential) V1 at the time of the light emission pulse level of the semiconductor laser being at the maximum are measured by use of an electrometer (S2 to S5).

Likewise, with the grid potential being set at Vg2=−500V and Vg3=−700V, the Vd and V1 are measured in the same manner as described above (S6 to S15). Then, the data on the grid potential −300V and −500V, and the data on the grid potential −500V and −700V are interpolated, and then, extrapolated to seek the relationship between the grid potential and the photosensitive drum surface potential (S16).

Then, from the surface potential Vd, the developing bias potential Vdc is set with the differential of the Vback (here, 150V) which is set in order to avoid any adhesion of foggy toner on an image (S17).

Subsequently, the contrast potential (Vcont+Vback), which is required at the time of image formation, is obtained by calculating the moisture amount from the temperature and humidity of an apparatus, which are detected by use of the environmental sensor provided for the apparatus. Here, the Vcont is a differential voltage of the Vdc and V1.

With the relationship represented in FIG. 8 and from this contrast potential, it is possible to work out and obtain the required voltage of grid potential and the required voltage of developing bias potential. The control needed for obtaining these potential data is the potential control.

However, although it is possible to compensate for the sensitivity changes of the photosensitive member if the potential control is executed per copy sequence initiation, the printout throughput is reduced eventually. Usually, therefore, the aforesaid potential control is executed immediately after the main power source of an image forming apparatus is turned on or after a passage of a designated time, that is, for example, two hours after the previous execution of potential control. During such period of time, the grid potential previously obtained, and the developing bias potential are used for control.

In general, however, it is practiced to arrange a structure for actual patch detection control in which the toner density control is executed in a developing container by means of one patch control (hereinafter referred to the "one patch toner density control") in consideration of such problems as complication encountered in controlling plural patches, unavoidable increase of downtime, among some others. Nevertheless, in order to enhance the printout throughput even for the one patch toner density control, the frequency of patch detection trial, the replenishment control between patch detections, the countermeasure to prevent an image from being degraded due to increase or decrease of toner density in a developing container, and the like are important conditions of image formation.

Further, for the apparatus that uses the aforesaid two controls, the light portion and dark portion potentials are compensated by the potential control method, but the patch detection control is executed in a status where no compensation is possible for any halftone potential. As a result, the image density is caused to change greatly eventually due to the halftone sensitivity differential (before and after duration or the like) of the photosensitive drum, which is subjected to changes as time elapses.

Figure 4:
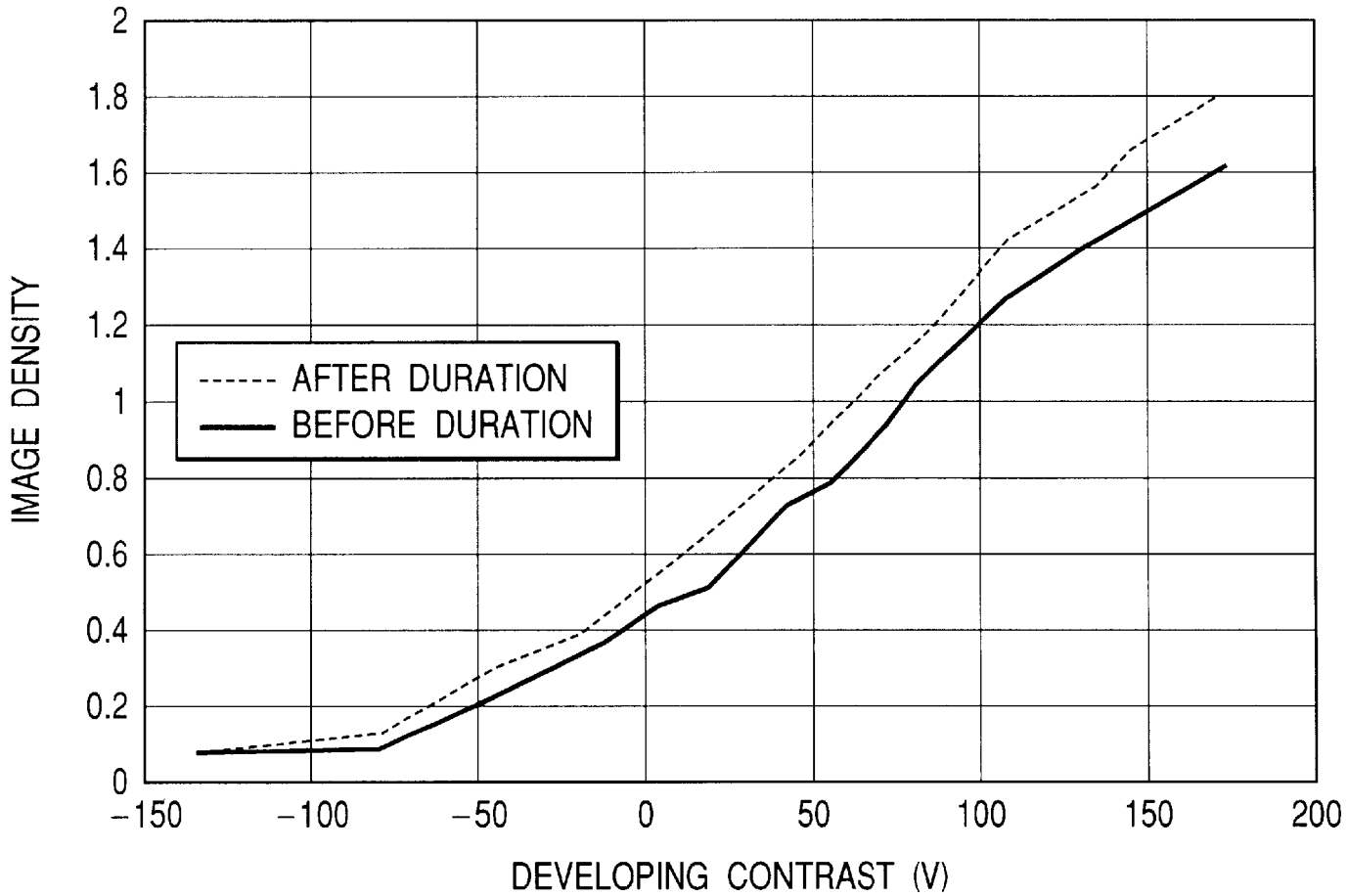
FIG. 4 is a view which shows the development characteristics before and after duration due to the potential changes of the photosensitive drum represented in FIG. 3.

Therefore, if a patch detection control is executed on the photosensitive drum after duration where the sensitivity thereof is reduced, the halftone latent image potential, that is, the patch latent image potential, is higher than the one in the initial stage. Consequently, the contrast potential of the patch image is lowered. Thus, the developing characteristics of the patch image are made lower than those before duration. In order to compensate for the lowered developing characteristics, control means is required to repeat toner replenishment. As a result, the developing characteristic curves indicate changes as shown in FIG. 4 when restoration is made to the developing characteristics in the initial stage. Here, the patch image density is set at the 0.8 level by the measurement value of the reflecting densitometer (manufactured by X-rite Inc.). Also, these characteristics are found to be conspicuous for a durable drum, that is, the photosensitive drum after a long-term use or under high moisture environment.

Figure 5:
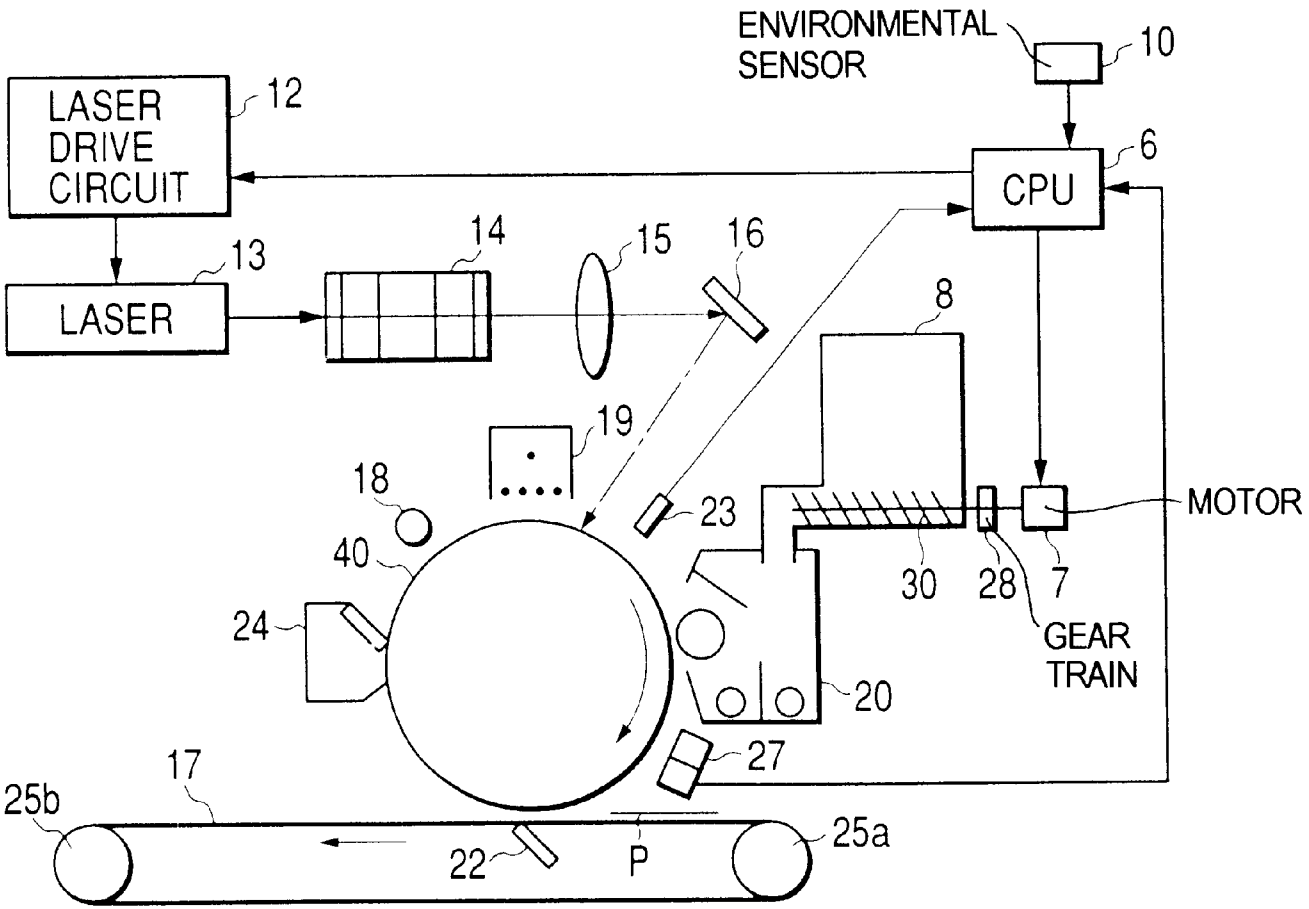
FIG. 5 is a view which schematically shows the structure of an image forming apparatus in accordance with another embodiment of the present invention.

Now, therefore, in accordance with the present embodiment, the arrangement is made to use an image forming apparatus shown in FIG. 5 (which is the image forming apparatus structured substantially the same as the one shown in FIG. 1; the same reference marks are applied to the same members shown in FIG. 1, and the detailed description will be omitted) so that the post-rotational sequence, that is, a patch image formation process, is executed when the usual image formation (the same as the first to fourth embodiments) is completed, and that the detected result of the patch latent image potential thus obtained is fed back to the next patch image formation. In this manner, it is attempted to make the down time of the apparatus as small as possible.

Now, the post-rotational sequence will be described in accordance with a flowchart shown in FIG. 6.

When the operation enters the post-rotational sequence, the laser level is determined at first (S100) for forming a patch of certain density level on the photosensitive drum 40 depending on the current detection result of the environmental sensor 10, the environmental history, or the like. Here, as the aforesaid density level for the present embodiment, the density patch at 0.8 of the X-rite reflecting densitometer is adopted. However, it is not necessarily limited thereto. The density patch of 0.5 to 1.2 level is preferably applicable.

Next, in the same manner as to form an image usually, the surface of photosensitive drum 40 is uniformly charged electrostatically by use of the first charger 19 to form the patch latent image at the laser level previously determined (S101).

After that, when the patch latent image passes the potential sensor 23, the patch latent image potential is detected (S102), and compared with the initially set patch latent image potential (S103). Then, if the detected one is higher than the initially set patch latent image potential, the ErrFlag is set at 1, and if it is lower, the ErrFlag is at −1 (S104), thus being transmitted to the controller 6.

When the patch latent image is carried to the developing position, it is developed by the two-component developer in the developing device 20 (S105). When the patch image thus developed passes the optical sensor 27, the patch image density is detected (S106), and the result of detection is transmitted to the controller 6 for comparison with the initial density (S107). If it is determined to be lower than the initial density, the required amount of replenishing toner is supplied from the replenishment tank 22 to the developing device 20 (S108) by driving the toner conveyance screw 30 to rotate by use of the motor 7. If it is determined to be higher, a signal is issued to suspend replenishment (S109). Thus, the post-rotational sequence is completed.

Next, the description will be made of a method for feeding back the condition of reference image formation. Here, the control is described with respect to the case where the patch latent image potential is higher than the initial potential in the aforesaid post-rotational sequence, that is, the control in an operation that enters the past-rotational sequence given below in the status of ErrFlag=1.

In accordance with the present embodiment, the operation enters the post-rotational sequence, and then, the laser level is determined at first by the environmental sensor 10 or the like that detects the environmental temperature and humidity in the step of determining laser level. After that, the laser level is increased by one step in order to make the patch latent image potential lower in the laser driving circuit 12, thus forming the patch latent image. Thereafter, the sequence is the same as the post-rotational one described above.

As a result of this control, it becomes possible to make the patch latent image potential lower than the previous patch latent image potential in the patch latent image potential detecting step (S102). Then, in this post-rotational sequence, the patch latent image potential is detected, and if the resultant patch latent image potential maintains the higher status, the operation proceeds to step S105 without forming a patch latent image again as in the first to fourth embodiments. The laser level of the detected result of the patch latent image potential obtained in the step S102 should only be increased by one step in the next post-rotational sequence (when a patch latent image is formed next time).

With the repetition of the patch latent image control in the post-rotational sequence, it is possible to approximate the patch latent image potential to the same potential as the initial one in a long run. Therefore, changes of developing capability brought about by changes of the photosensitive drum duration can be suppressed without increasing the down time of an apparatus.

As a result, the time during which no usual image formation is operable can be made as small as possible, thus suppressing the reduction of the image formation throughput as much as possible. This arrangement is particularly effective when an image is formed on a plurality of recording material P continuously.

In this respect, the description has been made of the case where the patch latent image potential is higher than the initial one, that is, the case of ErrFlag=1, but it is of course possible to execute the control in the aforesaid sequence when the patch latent image potential is lower than the initial one if only considered reversely in the execution thereof.

(Sixth Embodiment)

For the fifth embodiment, when the laser level is determined, the control is executed by changing the laser level by one step using the ErrFlag. However, the patch detection control is a halftone control, and as clear from the representation of FIG. 4 provided earlier, the developing characteristics near this density indicate an abrupt change. As a result, the one step change of the laser level may be accompanied by an extremely large density change in some cases. Consequently, color tone may vary in an image formed by an image forming apparatus that uses a plurality of photosensitive drums.

Now, in accordance with the present embodiment, the patch potential difference is worked out by the following formula (1):

$$\text{Patch potential difference} = \text{patch latent image potential} - \text{initial potential} \quad (1)$$

Then, depending on the patch potential difference thus obtained, the patch laser level is changed. More specifically, the amount of laser level change is obtained by the following formula (2) for the present embodiment:

$$\text{The amount of laser level change} = \text{patch potential difference}/10(V) \quad (2)$$

Based on the value thus obtained, the patch laser level is changed.

Thus, the durable density stabilization is attained without creating any considerable density changes.

In this respect, for the present embodiment, the amount of laser level change is obtained by the formula (2), but there is no problem if it is changed in accordance with the characteristics of photosensitive drum or it is controlled by use of a table on which the amounts of laser level changes are listed corresponding to the environmental conditions or patch potential differences.

(Seventh Embodiment)

Next, in conjunction with FIG. 7, the present embodiment will be described.

In accordance with the present embodiment, the patch latent image potential measurement and the patch laser level determination are executed immediately after a potential control, besides those at the time of post-rotation. Usually, the potential control sequence is executed at the time of pre-rotation during a copying operation. The following description is made as a sequence at the time of pre-rotation.

At first, subsequent to having compensated for the light portion and dark portion potentials in the potential control sequence described earlier (S200), a patch latent image is formed at the laser level which has been worked out in accordance with the current environment, the environmental history, or the like (S201 and S202). Then, the patch latent image potential is detected (S203) to compare it with the patch initial potential (S204). If it is higher than the patch initial potential, the ErrFlag is set at 1, and if it is lower, the ErrFlag is set at −1 (S205). From the result thus obtained, the patch laser lever is increased by one step in the case of ErrFlag=1, and it is decreased by one step in the case of ErrFlag=−1 (S201). Thus, a latent image is formed again (S202) to measure the electrostatic potential (S203). In this way, the laser level is retrieved so as to make it equal to the initial potential.

In accordance with the aforesaid control, it is possible to obtain a better result, because the patch latent image potential can be compensated, while being in a status where the light portion and dark portion potentials have been compensated. Further, with the patch laser level thus determined being stored on the controller, it becomes comparatively easy to find a desired patch laser level when the sensitivity of a photosensitive drum is caused to change in an operation thereafter.

(Eighth Embodiment)

For the above embodiment, the laser level, namely, the laser exposing time is changed in order to make the patch latent image potential equally to the initial potential, but for the present embodiment, the laser exposure intensity is changed instead.

Figure 6:
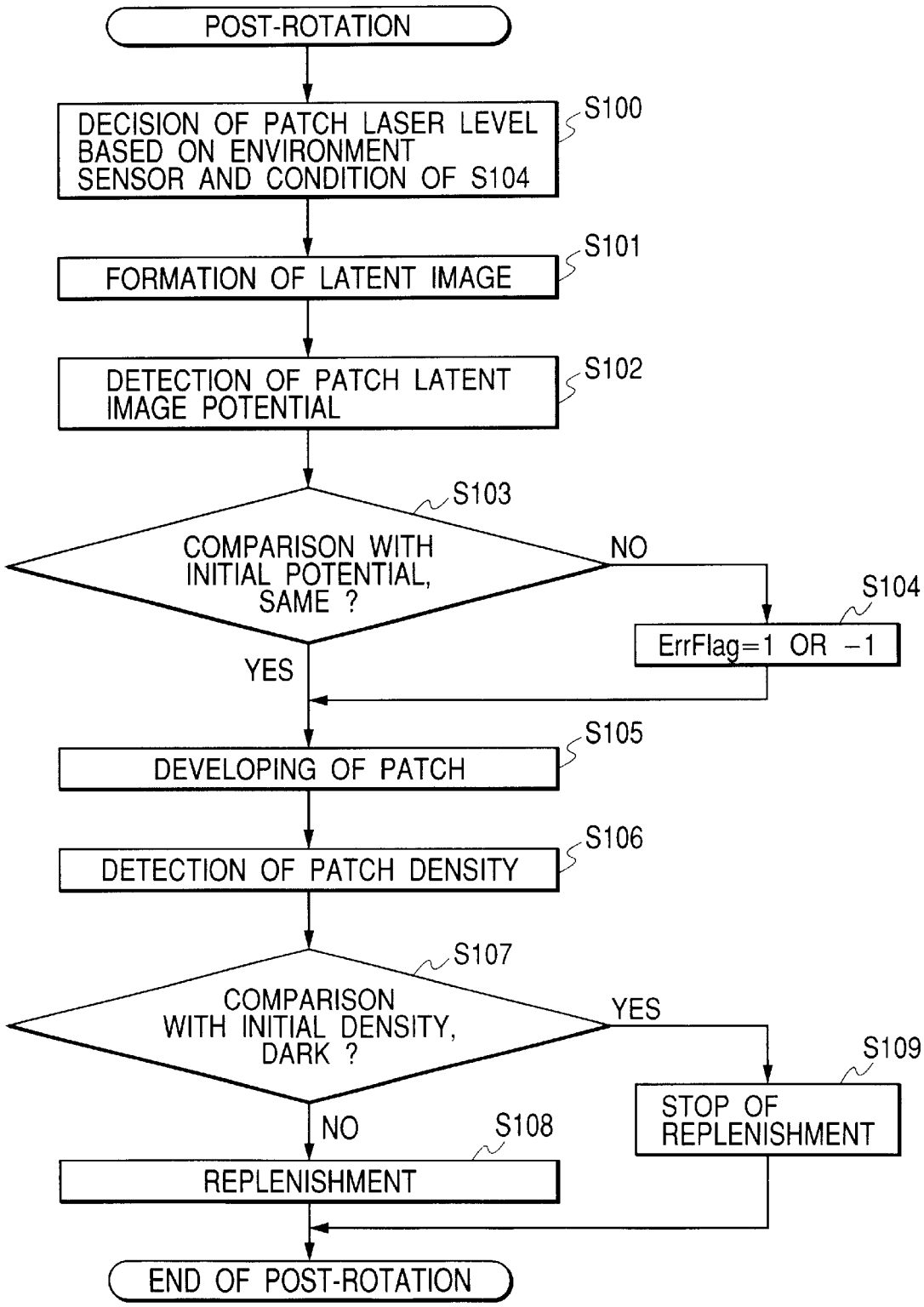
FIG. 6 is a flowchart which shows one embodiment of post-rotation sequence.
Figure 7:
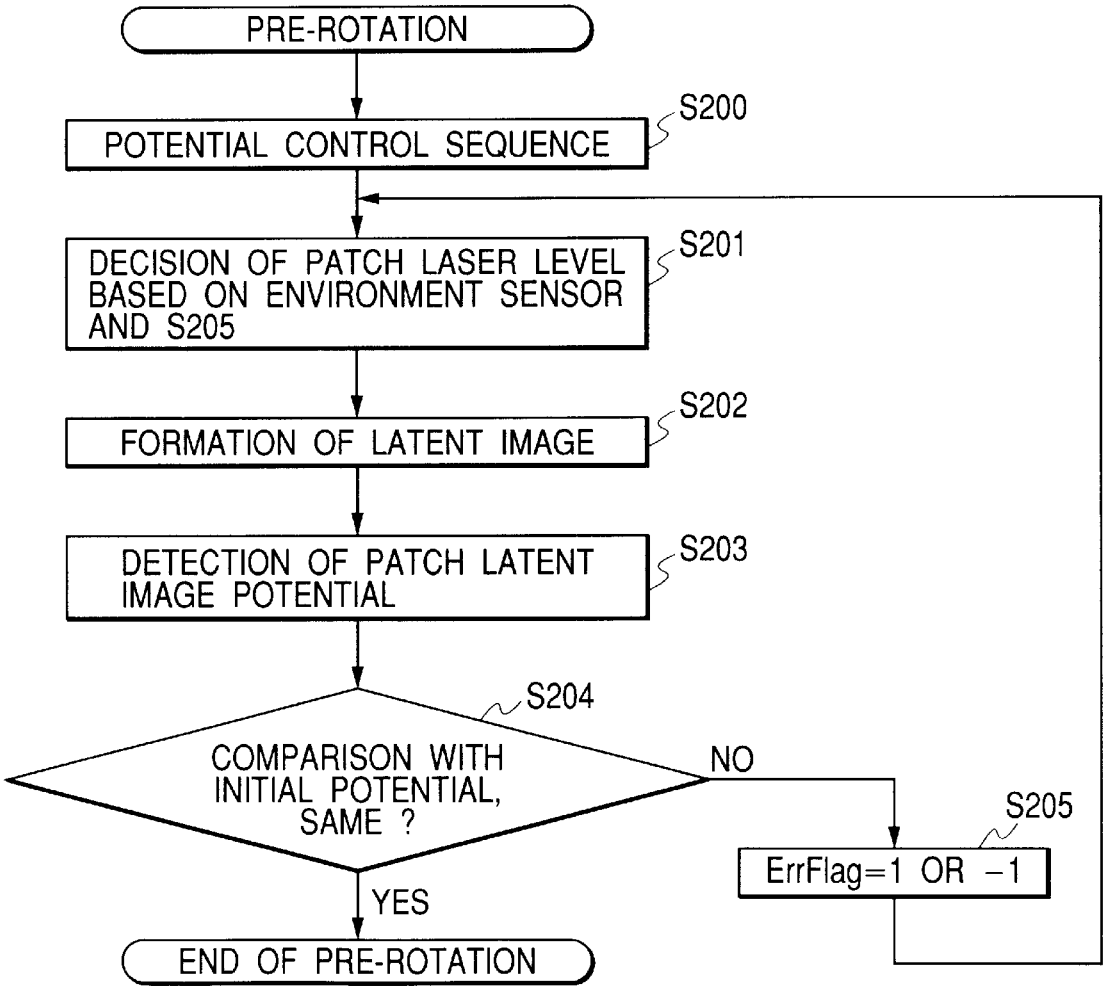
FIG. 7 is a flowchart which shows one embodiment of pre-rotation sequence.

More specifically, in the steps S104 and S205 shown in FIG. 6 and FIG. 7, The laser power is increased by one step in the case of ErrFlag=1, and the laser power is decreased by one step in the case of ErrFlag=−1. In this way, the same effect can be obtained as the above embodiment.

(Ninth Embodiment)

For the first to eighth embodiments, an organic photosensitive member is used as an image bearer, but it may be possible to use an amorphous silicon sensitive member instead. Here, the patch latent image potential control described respectively for the first to eighth embodiments is executed in an image forming apparatus that uses such an amorphous silicon photosensitive member as this.

The amorphous silicon photosensitive member has an extremely high Vickers hardness of 1,500 to 2,000 kg/cm$^2$ (=$1.5\times10^2$ to $2.0\times10^2$ MPa). Therefore, it is practically used as a long-life drum. Nevertheless, it is well known that this type of photosensitive member has an extremely large dark decay as the characteristic thereof. For that matter, an image forming apparatus that uses the amorphous silicon drum and the patch detection control together is encountered with a serious problem that the control becomes complicated owing to the preparation of many tables, which is unavoidable in correcting the dark decay, as well as the sensitivity changes, and also, owing to the changes of developing duration brought about by the uneveness of initial setting.

In accordance with the first to fourth embodiments, however, the initial setting is made after having determined the image forming condition which becomes a designated patch latent image potential at the time of initial setting. As a result, the table that should be prepared for an apparatus used for the present embodiment is good enough if only it indicates the environmental patch latent image potentials. Also, the present embodiment makes it possible to suppress the image density changes even after a long-term use.

Also, in accordance with the fifth to eighth embodiments, the same effect can be obtained, while eliminating the complication of preparing many tables by the execution of control that enables the patch latent image potential to be the same as the initial one.

Also, it is particularly effective if the present invention is applied to an image forming apparatus that adopts the tandem type having a plurality of image bearers provide therefor (which is structured in which a manner that the image forming station shown in FIG. 1 and FIG. 5 is installed in plural numbers, and toner image from each of the image bearers is superposed one after another on a recording material P, and transferred for the formation of color image). In other words, it becomes possible to optimize the output image density per image forming station, and obtain a high quality image having no changes in color tones of the color image thus formed. Also, when a toner image is transferred from each of the image bearers, not only a recording material P is usable, but also, a known so-called intermediate transferring material is adoptable. In this case, the structure is arranged so that a color image, which is transferred from each image bearer to such intermediate transferring material one after another to be superposed for the primary transfer, is transferred to a recording material P altogether for the secondary transfer.

Although the present invention has been described specifically with reference to the first to ninth embodiments, it is not meant to be construed in a limiting sense. Various modifications of the disclosed embodiments, as well as other embodiments of the invention, will become apparent with reference to the description of the invention. It is therefore contemplated that the appended claims will cover any modifications as fall within the true scope of the invention.

What is claimed is:

1. An image forming apparatus comprising:

an image bearing member;

a developer container for containing developer including toner and carrier;

image forming means for forming a toner image on said image bearing member using developer contained in said developer container;

a density sensor for detecting density of the toner image;

control means for controlling an amount of toner for replenishing to said developer container by comparing a detection output of said density sensor unit with a target value;

execution means for forming a predetermined toner image using said image forming means and executing a detection process of detecting a density of the predetermined toner image using said density sensor in conjunction with completion of an exhange of developer; and setting means for setting, on the basis of an output obtained by the detection process, an initial target value to be compared with the detection output of said density sensor.

2. An image forming apparatus according to claim 1, wherein the exchange of developer includes an exchange of a toner replenishment container containing toner for replenishing to said developer container.

3. An image forming apparatus according to claim 1, wherein said image forming means forms the predetermined toner image under an image forming condition responding to an atmosphere environment.

4. An image forming apparatus according to any one of claims 1 to 3, further comprising:

a potential sensor for detecting potential of an electrostatic latent image formed on said image bearing member; and potential control means for controlling potential of the electrostatic latent image in accordance with an output of said potential sensor, wherein said execution means forms a predetermined electrostatic latent image on said image bearing image bearing member and executes a control process of controlling potential of the predetermined electrostatic latent image in conjunction with the completion of the exchange of developer.

5. An image forming apparatus according to claim 4, wherein said execution means executes said detection process by using the predetermined elctrostatic latent image after executing the control process.

6. An image forming apparatus comprising:

an image bearing member;

developing means for developing by developer including toner and carrier an electrostatic latent image formed on said image bearing member;

a density sensor for detecting density of the developed image;

control means for controlling an amount of toner for replenishing to said developing means by comparing a detection output of said density sensor with a target value;

setting means for setting the target value in accordance with the detection output of said density sensor;

a potential sensor for detecting potential of an electrostatic latent image formed on said image bearing member;

potential control means for controlling potential of the elctrostatic latent image in accordance with an output of said potential sensor; and execution means for executing a control process of controlling potential of the electrostatic latent image using said potential control means in starting a process of setting the target value.

7.An image forming apparatus according to claim 6, wherein the setting process is executed in conjunction with completion of an exchange of developer.

8. An image forming apparatus according to claim 7, wherein the exchange of developer includes an exchange of a toner replenishment container containing toner for replenishing to said developer means.

9. An image forming apparatus comprising:

an image bearing member;

a potential sensor for detecting a potential of an electrostatic latent image formed on said image bearing member;

potential control means for controlling the potential of the electrostatic latent image formed on said image bearing member in accordance with an output of said potential sensor;

developing means for developing by developer the electrostatic latent image formed on said image bearing member; and a density sensor for detecting a density of a developed image for detection obtained by said developing means developing an electrostatic latent image for detection formed on said image bearing member, wherein, when a result of potential detection obtained by said potential sensor after termination of a normal image formation process is out of a designated range, control processing by said potential control means is performed after termination of a next normal image formation process.

10. An image forming apparatus according to claim 9, wherein, after termination of the next normal image formation process, the detection process by said density sensor is executed by using the electrostatic latent image obtained by executing the potential control processing.

11. An image forming apparatus according to claim 10, further comprising control means for controlling an amount of toner for replenishing to said developing means in accordance with a detection output of said density sensor.

* * * * *

UNITED STATES PATENT AND TRADEMARK OFFICE

CERTIFICATE OF CORRECTION

PATENT NO. : 6,665,502 B2
DATED : December 16, 2003
INVENTOR(S) : Fumitake Hirobe et al.

It is certified that error appears in the above-identified patent and that said Letters Patent is hereby corrected as shown below:

Column 1,
Line 47, “an” should read -- a --.

Column 4,
Line 19, “binalized” should read -- binarized --.

Column 11,
Line 23, “The” should read -- the --.

Column 12,
Line 34, “unit” should be deleted.
Line 63, “image” (3rd occurrence) should be deleted.
Line 64, “bearing” should be deleted.

Column 13,
Line 29, “7.An” should read -- 7. An --.

Signed and Sealed this

Second Day of November, 2004

JON W. DUDAS
*Director of the United States Patent and Trademark Office*